US008579495B2

(12) United States Patent
Blechschmitt et al.

(10) Patent No.: US 8,579,495 B2
(45) Date of Patent: Nov. 12, 2013

(54) PROCESS FOR MIXING A LIQUID OR MIXTURE OF A LIQUID AND A FINE SOLID PRESENT IN AN ESSENTIALLY SELF-CONTAINING VESSEL

(75) Inventors: Michael Blechschmitt, Schifferstadt (DE); Ulrich Hammon, Mannheim (DE); Friedrich-Georg Martin, Heidelberg (DE); Klaus Joachim Mueller-Engel, Stutensee (DE); Peter Zehner, Weisenheim am Berg (DE)

(73) Assignee: BASF SE, Ludwigshafen (DE)

( * ) Notice: Subject to any disclaimer, the term of this patent is extended or adjusted under 35 U.S.C. 154(b) by 477 days.

(21) Appl. No.: 11/857,887

(22) Filed: Sep. 19, 2007

(65) Prior Publication Data

US 2008/0074944 A1 Mar. 27, 2008

Related U.S. Application Data

(60) Provisional application No. 60/846,095, filed on Sep. 21, 2006.

(30) Foreign Application Priority Data

Sep. 21, 2006 (DE) ..... 10 2006 045 088

(51) Int. Cl.
*B01F 13/02* (2006.01)

(52) U.S. Cl.
USPC ..... 366/101; 366/136; 366/163.2

(58) Field of Classification Search
USPC ..... 137/565.22, 888; 261/25; 366/101, 136, 366/137, 158.5, 163.2
See application file for complete search history.

(56) References Cited

U.S. PATENT DOCUMENTS

| | | | | | |
|---|---|---|---|---|---|
| 626,950 | A | * | 6/1899 | Wheelwright | 366/134 |
| 701,553 | A | * | 6/1902 | Evans | 261/25 |
| 928,374 | A | * | 7/1909 | Ford et al. | 222/630 |
| 1,000,689 | A | * | 8/1911 | Paterson | 422/106 |
| 1,406,599 | A | * | 2/1922 | Wilson | 134/94.1 |
| 1,590,370 | A | * | 6/1926 | Hallquist | 68/183 |
| 1,777,646 | A | * | 10/1930 | Klein et al. | 366/136 |
| 2,073,784 | A | * | 3/1937 | Day | 210/765 |
| 2,645,463 | A | * | 7/1953 | Stearns | 366/158.5 |
| 2,665,035 | A | * | 1/1954 | Schemm | 222/195 |
| 3,334,868 | A | * | 8/1967 | Lage | 366/136 |
| 3,620,507 | A | * | 11/1971 | Kruka | 366/155.2 |
| 3,741,533 | A | * | 6/1973 | Winn, Jr. | 366/136 |

(Continued)

FOREIGN PATENT DOCUMENTS

| | | |
|---|---|---|
| DE | 1 557 018 | 3/1970 |
| DE | 24 04 289 | 8/1975 |

(Continued)

OTHER PUBLICATIONS

Japanese Office Action issued Jan. 20, 2012 in patent application No. 2009-528695 (English translation only).

*Primary Examiner* — David Sorkin
(74) *Attorney, Agent, or Firm* — Oblon, Spivak, McClelland, Maier & Neustadt, L.L.P.

(57) ABSTRACT

A process for mixing a liquid stored in a vessel, in which gas is sucked in from the gas phase present above the liquid interface with a suction apparatus present in the liquid, and released into it again for the gas-induced mixing of the liquid.

23 Claims, 10 Drawing Sheets

(56) References Cited

U.S. PATENT DOCUMENTS

| | | | | | |
|---|---|---|---|---|---|
| 3,931,248 | A | * | 1/1976 | Maekawa et al. | 549/501 |
| 3,938,738 | A | | 2/1976 | Nagel et al. | |
| 4,168,936 | A | | 9/1979 | Scheller et al. | |
| 4,175,872 | A | * | 11/1979 | Primus | 366/139 |
| 4,215,081 | A | * | 7/1980 | Brooks | 261/122.1 |
| 4,568,196 | A | * | 2/1986 | Hacheney | 366/348 |
| 4,582,638 | A | * | 4/1986 | Homer et al. | 588/16 |
| 4,812,511 | A | * | 3/1989 | Domeier | 524/850 |
| 4,865,333 | A | | 9/1989 | Winslow | |
| 4,883,363 | A | * | 11/1989 | Pillon et al. | 366/157.4 |
| 5,035,842 | A | * | 7/1991 | Mohn | 261/76 |
| 5,135,684 | A | * | 8/1992 | Mohn et al. | 261/76 |
| 5,399,460 | A | * | 3/1995 | Aldrich et al. | 430/287.1 |
| 5,472,823 | A | * | 12/1995 | Hagiwara et al. | 430/270.1 |
| 5,727,792 | A | | 3/1998 | Rockwood | |
| 5,811,595 | A | * | 9/1998 | Ellis | 568/620 |
| 5,814,715 | A | * | 9/1998 | Chen et al. | 526/348.6 |
| 5,845,993 | A | * | 12/1998 | Shirtum et al. | 366/348 |
| 5,951,921 | A | | 9/1999 | Koganezawa et al. | |
| 6,017,022 | A | * | 1/2000 | Shirtum | 261/75 |
| 6,207,744 | B1 | * | 3/2001 | Paulus et al. | 524/507 |
| 6,234,762 | B1 | * | 5/2001 | Lucas | 417/126 |
| 6,250,796 | B1 | * | 6/2001 | Huang | 366/270 |
| 6,416,213 | B1 | * | 7/2002 | Fukunaga | 366/158.5 |
| 6,488,476 | B2 | * | 12/2002 | Eck | 417/76 |
| 6,523,991 | B1 | * | 2/2003 | Maklad | 366/163.2 |
| 6,610,798 | B1 | * | 8/2003 | Bleijenberg et al. | 526/88 |
| 6,899,452 | B2 | * | 5/2005 | Hamamoto et al. | 366/152.2 |
| 6,910,511 | B2 | | 6/2005 | Yada et al. | |
| 6,939,991 | B2 | * | 9/2005 | Thiel et al. | 562/545 |
| 6,943,223 | B1 | * | 9/2005 | Bleijenberg et al. | 526/88 |
| 7,291,761 | B2 | * | 11/2007 | Machhammer et al. | 585/658 |
| 2003/0095471 | A1 | * | 5/2003 | Hamamoto et al. | 366/151.1 |
| 2004/0151640 | A1 | * | 8/2004 | Benfer et al. | 422/129 |
| 2004/0201120 | A1 | * | 10/2004 | Colbert | 264/45.8 |
| 2004/0206617 | A1 | * | 10/2004 | Diehl et al. | 203/8 |
| 2005/0109377 | A1 | * | 5/2005 | Schliephake et al. | 134/22.11 |
| 2005/0119515 | A1 | * | 6/2005 | Machhammer et al. | 585/658 |
| 2006/0036023 | A1 | * | 2/2006 | Kamata et al. | 524/556 |
| 2008/0073444 | A1 | * | 3/2008 | Blechschmitt et al. | 239/8 |

FOREIGN PATENT DOCUMENTS

| | | | | |
|---|---|---|---|---|
| DE | 24 10 570 | | | 9/1975 |
| DE | 10 2004 034 515 | A1 | | 2/2006 |
| EP | 0 245 844 | A1 | | 11/1987 |
| EP | 261822 | A2 | * | 3/1988 |
| EP | 1 092 874 | A2 | | 4/2001 |
| JP | 50-121862 | | | 9/1975 |
| JP | 62225242 | A | * | 10/1987 |
| JP | 03174236 | A | * | 7/1991 |
| JP | 10-216490 | | | 8/1998 |
| JP | 2003-245536 | | | 9/2003 |
| JP | 2003-275557 | | | 9/2003 |
| WO | WO 99/21893 | A2 | | 5/1999 |
| WO | WO 99/24161 | A1 | | 5/1999 |
| WO | WO 99/59717 | A1 | | 11/1999 |
| WO | WO 00/64947 | A1 | | 11/2000 |
| WO | WO 2004/003389 | A1 | | 1/2004 |
| WO | WO 2005/049543 | A1 | | 6/2005 |
| WO | WO 2006/024370 | A1 | | 3/2006 |

* cited by examiner

PROCESS FOR MIXING A LIQUID OR MIXTURE OF A LIQUID AND A FINE SOLID PRESENT IN AN ESSENTIALLY SELF-CONTAINING VESSEL

The present invention relates to a process for mixing a liquid or mixture of a liquid and a fine solid present in an essentially self-contained vessel, with the proviso that the liquid or mixture fills only part of the internal volume of the vessel occupiable by a fluid phase, and the remaining occupiable internal volume of the vessel is filled by a gas phase, comprising supply of essentially the same liquid or essentially the same mixture into the vessel as a motive jet of a suction apparatus disposed in the liquid or in the mixture in the vessel.

The storage of liquids or of mixtures of a liquid and a fine solid in essentially self-contained vessels is common knowledge (for example for the purpose of storage). Typically, such vessels are also referred to as tanks. Normally, the vessels are not entirely self-contained, but rather generally have, for example, at least one withdrawal point through which it is possible to withdraw from the contents stored in the vessel as required, for example by means of a pump. Correspondingly, the vessel typically also has at least one feed point through which the contents to be stored can be supplied to the vessel. Shutoff members (for example valves or ballcocks) normally enable the liquid or the mixture to be let in and out, and simultaneously ensure that leaks are prevented when the vessel is inactive. In a similar manner, instruments for measuring temperature, fill level and pressure in the tank (vessel) can be introduced into the vessel.

Normally, the liquid or mixture of a liquid and a fine solid which is to be stored in the tank does not completely fill the internal volume occupiable by a fluid (gaseous or liquid) phase. Instead, for a wide variety of different reasons, some of this internal volume is occupied by a gas phase. When the liquid or mixture is stored at atmospheric pressure, the essentially self-contained vessel can in principle be open to the atmosphere on the gas phase side (for example via an offgas system leading through a flare (or another offgas purification system (for example gas scrubbing))). The opening cross section is normally such that it is firstly sufficiently small and secondly such that the gases balance in the course of filling and emptying of the vessel with significant pressure drop. Typically, the mean diameters of such opening cross sections are ≤25 cm (at fill volumes of typically ≥100 $m^3$, frequently up to 10 000 $m^3$). Alternatively, devices for pressure release in the event of impermissible elevated pressure or reduced pressure, which seal tight to the response pressure (which may be at or above or below atmospheric pressure), are typically likewise installed into the relevant storage vessels (for example non-return valves). Frequently, the fill level in the storage tank is determined continuously at predefined heights in the gas and in the liquid phase by metering in a small amount (based on the volume of the gas phase in the vessel, generally <1% by volume/h) of a measurement gas. When the contents are known, the fill level is calculated directly from the difference of the metering pressure required for this purpose in each case.

In many cases, it is necessary that the contents of such a storage tank which are variable over time as a result of withdrawal and/or addition are mixed from time to time or constantly in order to increase or to ensure its homogeneity. The causes of this may be a wide variety of reasons. When the contents of the vessel are a mixture of a liquid and a fine solid (for example a slurry), there is frequently the risk that the fine solid settles out under the action of gravity during the storage in the tank, and the tank contents thus demix in the course of time. In the case of a withdrawal from the storage tank, it would then possibly, for example, no longer be the desired mixture which is withdrawn but rather only the liquid present therein. Examples of the aforementioned case include aqueous polymer suspensions. Depending on the specific weight of the liquid phase the fine solid present therein in disperse distribution can also cream and become enriched in the liquid/gaseous phase interface. One possible example of this is polymer dispersions (also aqueous polymer dispersions).

When only a liquid is stored in the tank (vessel), this may likewise be multiphasic (for example an emulsion; examples include oil-in-water emulsions and water-in-oil emulsions) and demix in the course of prolonged storage without intermediate homogenization, which is normally undesired.

However, a chemically homogeneous liquid too may form undesired physical inhomogeneities in the course of storage. These may consist, for example, of an inhomogeneous temperature distribution (for example caused by solar irradiation on one side of the tank). The consequence of this may, for example, be undesired crystal formation or unwanted decomposition of the liquid stored. Frequently, for the purpose of maintaining a desired storage temperature, a portion of the stored liquid may also be withdrawn continuously, conducted through a preferably indirect heat exchanger and then recycled into the storage tank. In this case, the storage vessel operator typically aims for very rapid temperature balancing between liquids still present in the storage vessel and liquid recycled into it via the heat exchanger by suitable rapid mixing. For the safe storage of free-radically polymerizable compounds (or solutions comprising them), for example acrolein, methacrolein, acrylic acid, methacrylic acid and/or esters thereof (especially the $C_1$- to $C_8$-alkyl esters), not only is careful temperature control of the liquid tank contents required. Instead, so-called inhibitors (free-radical scavengers) have to be added to the aforementioned, generally at least monoethylenically unsaturated, organic compounds (monomers), in order to avert and to prevent the occurrence of an accidentally initiated, undesired free-radical polymerization, in many cases, such inhibitors display their full effect only in the presence of molecular oxygen (which may in turn itself be an inhibitor). For this reason, such monomers are normally stored under a gas atmosphere comprising molecular oxygen (cf., for example, WO 2005/049543 and U.S. Pat. No. 6,910,511), and it should be ensured that the liquid monomer (or its solution) does not become depleted of the molecular oxygen dissolved therein. The latter can occur, for example, when the monomer temporarily crystallizes out locally and then goes back into solution. The resulting local depletion of molecular oxygen can equally be counteracted by appropriate mixing.

Should undesired free-radical polymerization of the tank contents be triggered in spite of the above-described precautionary measures, it can be counteracted by adding a medium for immediately ending the free-radical polymerization to the tank contents within a very short time and distributing it over the tank contents very rapidly (cf., for example, WO 00/64947, WO 99/21893, WO 99/24161, WO 99/59717). In this case too, very uniform and rapid mixing of the tank contents is required after the medium has been added.

In principle, the liquid contents of a tank can be mixed (cf. FIG. 1) by, for example, bubbling or jetting (for example through a "shower head") a suitable gas into the tank close to the bottom. The gas bubbles ascending within the liquid tank contents accomplish the desired mixing by entraining liquid. The entire (in principle, the mixing action even increases from the bottom upward) liquid vessel contents is thus covered and mixed efficiently by such a large-volume flow irrespective of the height of the liquid level. However, a disadvantage of such a procedure is the constant demand for a suitable mixing gas during the mixing (on the industrial scale, comparatively large gas volume streams are required to mix the tank contents). Moreover, this gas has to be conducted back out of the tank constantly. In the case of bubbling through the liquid tank contents to be mixed, it additionally normally becomes saturated with the liquid present in the tank and, owing to this loading (for example in the case of a stored organic liquid), it frequently cannot be released into the environment in a simple manner. Instead, in most cases, comparatively complicated (expensive) offgas treatment (for example combustion (in these cases, the gas which necessarily escapes as the tank is filled is combusted in a flare) or washing) is required. In principle, the mixed gas conducted out of the tank can also be recycled back into it for bubbling through the liquid contents thereof. However, it disadvantageously necessarily requires a separate cycle gas compressor which recompresses the offgas to the pressure at the vessel bottom. Such compressors are not only expensive but also cause a high level of maintenance and a not inconsiderable energy demand.

Alternatively, the tank contents can be mixed by means of a stirrer. However, this requires a separate drive source and a drive shaft conducted through the vessel wall. However, the sealing of rotating elements conducted through a vessel wall is generally found to be particularly difficult. Moreover, in the case of large fill volumes of a tank (industrial scale fill volumes for storage tanks are typically from 100 $m^3$ to 10 000 $m^3$, frequently from 200 to 1 000 $m^3$ or from 300 to 800 $m^3$, characteristically 500 $m^3$), the manufacture of a stirrer is already comparatively expensive.

Against this background, it has found to be appropriate to mix the liquid tank contents by withdrawing therefrom, with the pump available for tank withdrawal, a portion of the liquid or mixture of a liquid and a fine solid stored in the tank (vessel), and recycling at least some of the portion withdrawn through a motive nozzle which is disposed close to the bottom of the tank and is directed upward (in the simplest case a flow channel with cross section narrowing in flow direction, in which the pressure energy of a liquid flowing through is converted with low losses to additional kinetic energy, and the liquid stream is thus accelerated) as a (motive liquid) liquid jet (motive jet) into the tank.

In the course of this, the liquid jet directed upward, according to the laws of the free jet, along its path through the liquid present in the tank, is sucked in by the liquid, and the liquid media become mixed. Alternatively or additionally, for the purpose of mixing, the filling (refilling, but also first filling) of the vessel with the liquid or mixture can be effected in such a way that the liquid or mixture is supplied via an aforementioned motive jet.

However, a disadvantage of this method of mixing is that the mixing action of the free jet only captures a comparatively restricted space around it, so that the mixing action achieved is normally not entirely satisfactory (FIG. 2).

A further disadvantage is that the liquid jet (especially in the case of falling fill level in the tank), owing to its comparatively high mea momentum density (and speed), leaves the liquid phase present in the tank comparatively easily (breaks through the phase interface between liquid and gaseous phase), and this leaving may be accompanied by intense droplet formation (spray formation) within the gas phase. This is disadvantageous especially when the tank contents comprise an organic liquid (for example acrolein, methacrolein, acrylic acid, methacrylic add, the esters of these acids or other organic monomers) whose gas phase may be explosive in the presence of molecular oxygen (cf., for example, DE-A 10 2004 034 515). Firstly, the finely distributed droplets in the gas phase increase their content of organic material, as a result of which a gas phase which may not have been explosive beforehand becomes an explosive gas phase, and the droplets formed regularly experience, in their flight through the gas phase, as a consequence of friction, electrical charging of their surface. Spark discharge which accrues as a consequence is capable of triggering ignition. When the droplets are those of an aqueous polymer dispersion, these may also, for example, film irreversibly in an undesired manner on their path through the gas phase and disrupt the polymer dispersion in later uses.

When the tank contents are the slurry of a fine solid in a liquid, the solid thrown onto the inner wall of the vessel by the jet which breaks through the phase interface may be capable of adhering to it, which removes it from the slurries stored in the vessel.

However, spray formation which is established as described above is also disadvantageous in the case of another liquid in that, inter alia, the small spray droplets have an elevated vapor pressure. This causes undesired evaporative cooling, which impairs the temperature constancy of the tank contents.

In order to intensify the mixing (cf. Chemie-Ing. Techn. 42, 1970, p. 474 to 479), in the prior art according to FIG. 3 of this application, a mixing chamber (2) (open at the inlet and outlet) is arranged beyond the motive nozzle (1) (the numerical addresses always relate to the figures of this application). As a result, the liquid present in the tank space is not, as in the case of a free jet, sucked in along the jet path, but rather the amount conveyed according to the law of momentum has to enter through the inlet cross section (3) of the mixing chamber (also referred to hereinafter in simplified terms as a momentum exchange chamber or as a momentum exchange tube; cross section need not, though, necessarily be circular; however, the tubular embodiment is appropriate from an application point of view). This arrangement of motive nozzle and mixing chamber (which is, for example, connected downstream of the motive nozzle as a short tube with larger cross section) will be referred to hereinafter as a jet nozzle. In it, the motive jet with comparatively high speed enters a momentum exchange chamber which is comparatively small in comparison to the tank volume (frequently, the volume of the momentum exchange chamber is only from approx. 0.0001 to 1% of the internal volume of the tank) and sucks in a circulating amount of the liquid present in the tank as it does so. A manufacturer of such suitable jet nozzles is, for example, GEA Wiegand GmbH in D-76275 Ettlingen.

The mixture which flows out of the momentum exchange tube has an already significantly weakened momentum of its elements (a reduced mea momentum density) in comparison to the motive jet, which lowers the above-described probability of exit with droplet formation (spray formation) (it will enter only at a comparatively lower level of the phase interface and with weakened mean exit momentum density; cf. FIG. 4). Together with the suction acting from below, the outflow directed upward out of the momentum exchange tube forms large-volume circular flow fields with continuous field lines according to FIG. 5, which, in the case of a jet nozzle directed obliquely upward and preferably mounted in the tank so as to be slightly raised (cf., for example, Acrylate Esters, A Summary Of Safety And Handling, 3rd Edition, 2002, compiled by Atofina, BASF, Celanese, Dow and Rohm & Haas), causes improved (especially more complete) mixing compared to the motive nozzle, which is, however, still not entirely satisfactory. Furthermore, when the fill level (the phase interface) falls below the suction level, the motive jet here too passes unhindered through the momentum exchange tube and sprays to form fine droplets with the risks already described (FIG. 6). in general, the motive jet liquid, before it enters the jet nozzle, therefore has to flow through valves which, when the fill level in the tank goes below a predefined level, close and prevent flow through them. The mixing action generally also decreases from the bottom upward.

In view of this prior art, it was an object of the invention to provide an improved process for mixing liquid tank contents, which can be applied to all above-described problem cases and not least also enables more rapid mixing.

Accordingly a process is provided for mixing a liquid or mixture of a liquid and a fine solid present (stored) in an essentially self-contained vessel, with the proviso that the liquid or mixture fills only part of the internal volume of the vessel occupiable by a fluid phase, and the remaining occupiable internal volume of the vessel is filled by a gas phase, comprising supply of essentially the same liquid or essentially the same mixture into the vessel as a motive jet of a suction apparatus disposed in the liquid or in the mixture in the vessel, wherein the suction apparatus, with the aid of the motive jet, sucks in gas from the gas phase present in the vessel and releases the sucked-in gas together with the motive jet into the liquid or mixture present in the vessel.

BRIEF DESCRIPTION OF THE DRAWINGS

A more complete appreciation of the disclosure and many of the attendant features thereof will be readily obtained as the same becomes better understood by reference to the following detailed description when considered in connection with the accompanying drawings, wherein.

Appropriately in accordance with the invention, the process according to the invention can be performed in a simple manner in such a way that it comprises the withdrawal of a portion of the liquid or of the mixture from the vessel and the recycling of at least some of the portion withdrawn as a constituent of the motive jet of the suction apparatus. In principle, the motive jet of the suction apparatus in the process according to the invention may also exclusively be at least some (or the entirety) of the liquid or mixture present in the vessel which has been withdrawn from the vessel beforehand.

If required, any part of the portion withdrawn which is not recycled as a motive jet can be sent to other uses.

It will be appreciated that the process according to the invention can also be performed without the liquid or mixture fed as a motive jet into the vessel comprising liquid or mixture withdrawn from the vessel, This is possible, for example, by virtue of the liquid or mixture to be conducted into the vessel for refilling being supplied to the vessel as a motive jet of the suction apparatus. It will be appreciated that the motive jet of the suction apparatus in the process according to the invention may also consist of a mixture of liquid or mixture to be conducted into the vessel for the purpose of refilling, and liquid or mixture withdrawn beforehand from the vessel.

Normally, the gas phase in the process according to the invention essentially does not experience any chemical conversion. In other words, the gas phase is essentially not consumed in the process according to the invention. In general, ≤1% by volume, preferably ≤0.75% by volume, more preferably ≤0.5% by volume, or ≤0.25% by volume, and most preferably ≤0.1% by volume, of the gas which is sucked out of the gas phase and is released into the liquid or mixture present in the vessel together with the motive jet is chemically changed as it is bubbled (ascends) once through the stored liquid or mixture.

Figure 7:
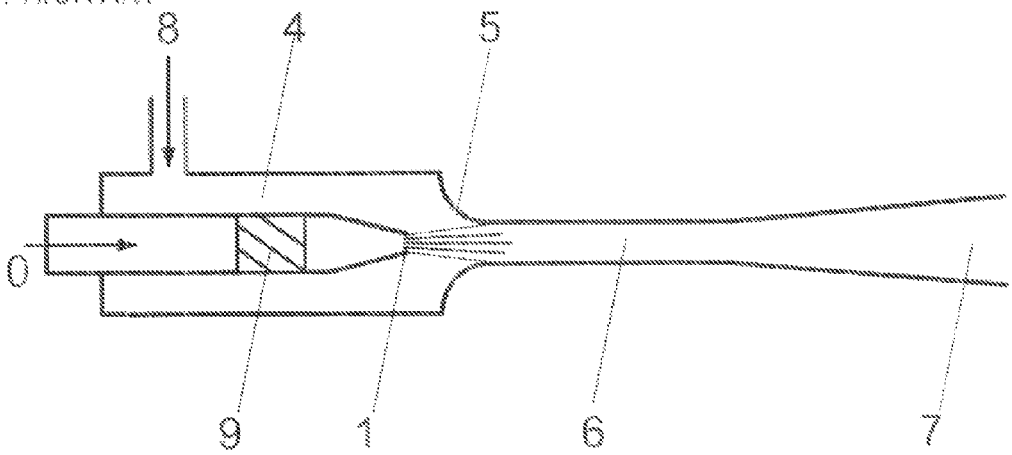
Figure 7 PRIOR ART
FIG. 7 shows an example of an ejector.

In the simplest form, the process according to the invention can be implemented with the aid of an ejector (i.e. by the principle of the water-jet pump) as the suction apparatus. In this case, the motive jet is pumped through a motive nozzle which is fitted into the ejector in such a way that gas is sucked out of the gas phase as it passes through the nozzles, for example via a riser tube which projects into the gas phase of the vessel (it is generally held by fillings fastened to the vessel wall), and is released in the form of divided gas bubbles into the liquid contents of the storage vessel together with the motive jet. The basic structure and the labels of an ejector (also referred to in the literature and hereinafter as a jet compressor) are shown in FIG. 7 (cf. also Chem.-Ing. Techn. 47., 1975/No. 5, page 209; Chemie-Ing.-Techn. MS201/75; vt >>verfahrenstechnik<<15 (1981) No. 10, p. 738 to 749; "Untersuchungen an Wasserstrahl-Luftpumpen mit einem einzigen kreiszylindrischen Treibstrahl" [Investigations on water-jet air pumps with a single cylindrical motive jet], D. I. G. v. Pawek-Rammingen, Thesis 1936, Brunswick Technical University; and "Mixing shocks and their influence on the design of liquid-gas ejectors", J. H. Witte, Thesis, Technical University, Delft (December 1962)).

An ejector (cf., for example, FIG. 7) consists (or comprises) generally of the motive nozzle (1), the suction chamber (4) (which normally surrounds the motive nozzle), the inlet to the mixing chamber (generally a mixing tube) (5), the mixing tube (mixing chamber) (6) and the diffusor (7), The rapid jet of motive liquid leaving the motive nozzle (which is pumped into the ejector at the point (0)) generates a reduced pressure in the suction chamber. As a result, the gas is sucked in (conveyed) from the suction chamber (whose inlet (8) is connected to the gas phase in the vessel (above the phase interface), for example via a gas-permeable connection (for example an appropriate riser tube)) and compressed owing to the exchange of momentum between motive liquid and gas in the mixing tube (mixing chamber) and diffusor, dispersed in the motive liquid and released together with it into the tank liquid, As it ascends in the latter, gas bubbles entrain the liquid and the desired mixing (which even becomes increasingly effective in the upward direction) in the stored liquid or in the stored mixture. The gas which is recycled through the phase interface into the gas phase can be sucked in again, etc.

Figure 3:
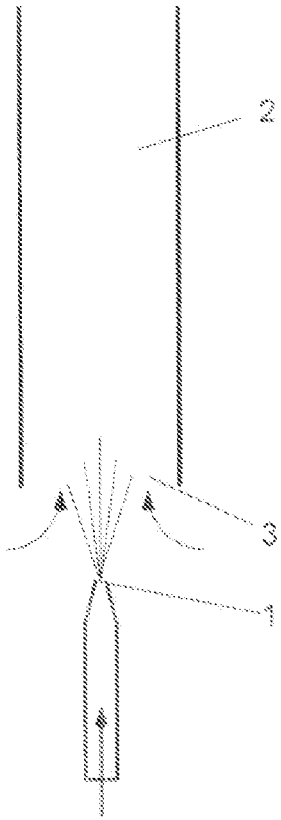
Figure 3 PRIOR ART
FIG. 3 shows an example of an arrangement of a mixing chamber arranged beyond the motive nozzle.
Figure 4:
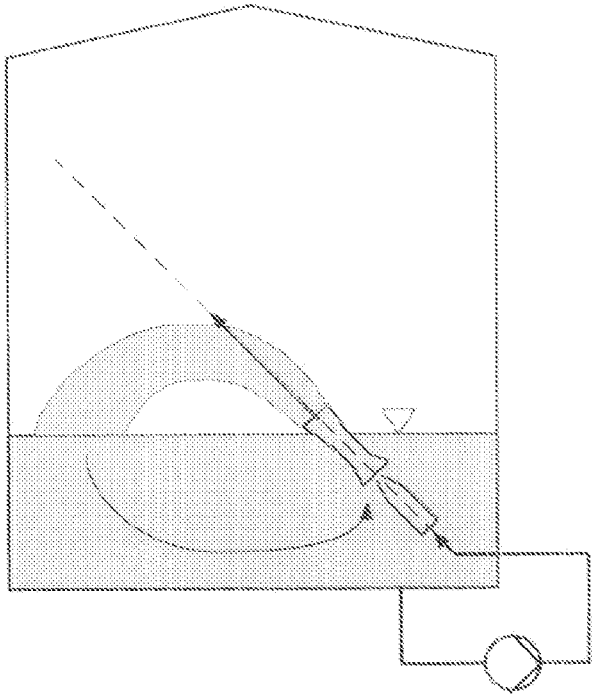
Figure 4 PRIOR ART
FIG. 4 shows an example of a motive jet.
Figure 5:
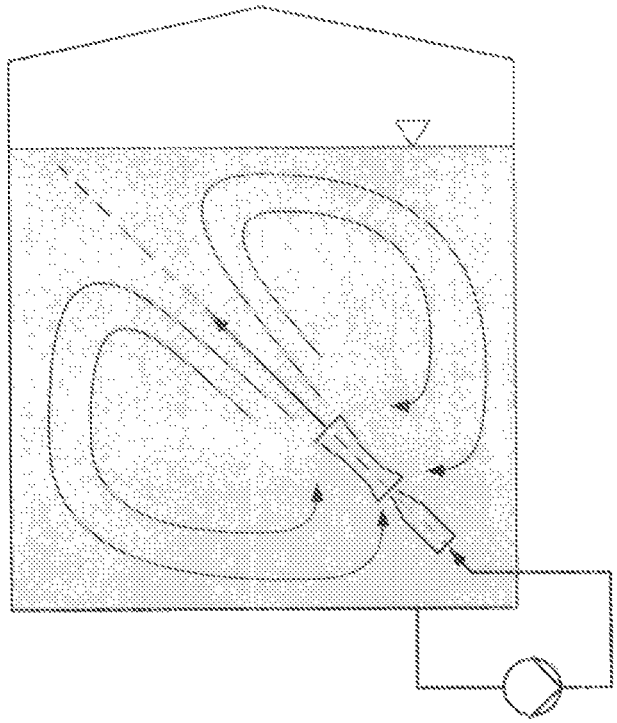
Figure 5 PRIOR ART
FIG. 5 shows an example of large-volume circular flow fields with continuous field lines.
Figure 6:
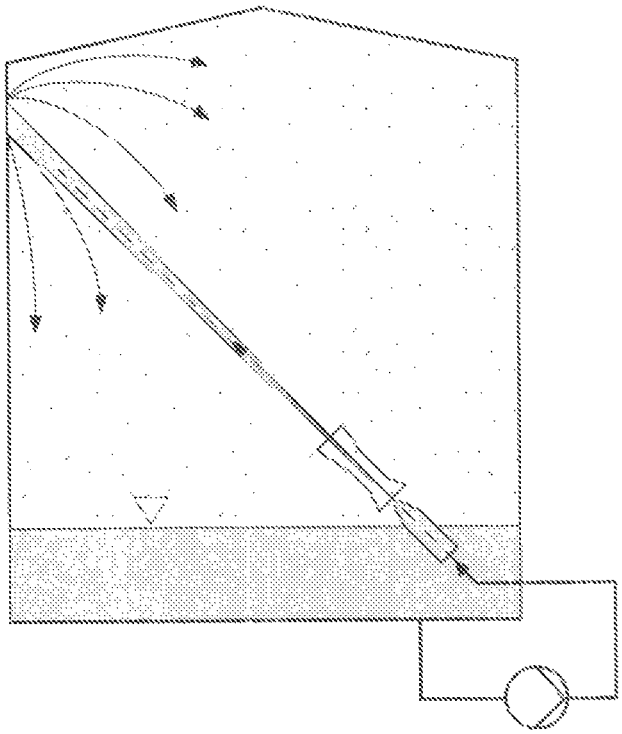
Figure 6 PRIOR ART
FIG. 6 shows and example of the fill level (the phase interface) falling below the suction level.

Motive nozzles whose nozzle openings generate liquid jets with increased turbulence are particularly advantageous, in the ejectors suitable in accordance with the invention, since motive jets leaving with increased turbulence entrain the gas from the suction chamber particularly effectively (the contact surface between gas and liquid phase is increased), which causes increased sucking action and increases the amount of gas sucked in per unit time, which improves the desired mixing. An additional improvement in the widening of the motive jet beyond its exit from the motive nozzle is achieved when a slight swirling motion is imparted to it before it passes through the motive nozzle. This is possible, for example, by installing suitable swirl bodies (9) just upstream of the motive nozzle. Useful such swirl bodies are, advantageously in accordance with the invention, for example, blade rings, as shown in FIG. 3 in vt >>verfahrenstechnik<<15 (1981) No. 10 on page 739. When swirl bodies which impart too great a swirl to the liquid jet are used (i.e. too highly swirled turbulent motive jets), however, a deterioration in the suction performance can also occur. In principle, the swirling can also be generated by a tangential motive liquid supply into the motive nozzle.

Figure 1:
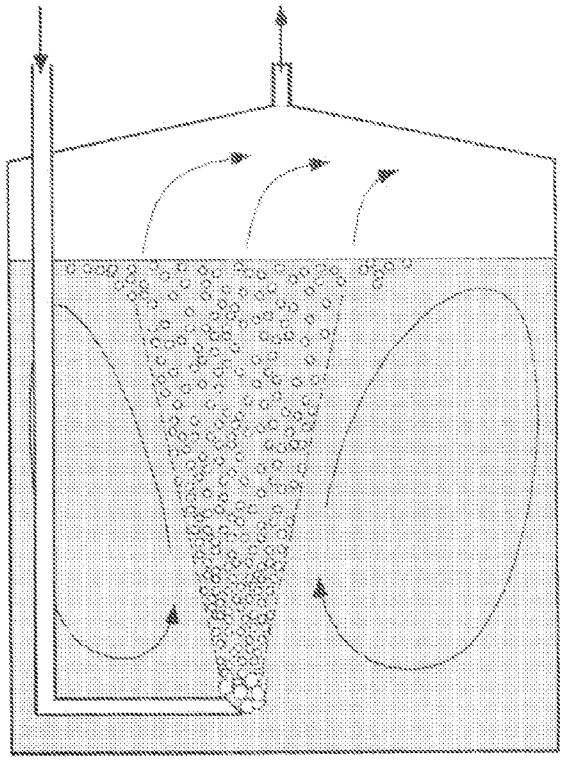
Figure 1 PRIOR ART
FIG. 1 shows an example of how liquid can be mixed by bubbling or jetting gas into a tank.
Figure 2:
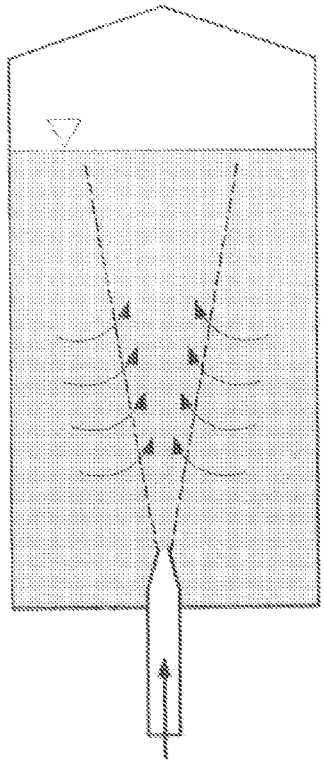
Figure 2 PRIOR ART
FIG. 2 shows an example of the mixing action when liquid is mixed by bubbling or jetting gas into a tank.

Alternatively and/or additionally to the swirling of the motive jet, it can be divided (into a plurality of individual jets), for example, by virtue of the exit cross section of the motive jet having a multitude of exit orifices (the cross section of the motive nozzle is provided with a motive jet divider). In the simplest manner, this is realizable by incorporating a screen (plate) which has a multitude of passage orifices (in the simplest case annular) into the exit cross section of the motive jet, as shown, for example, in FIG. 2 of the cited thesis by J. H. Witte on page 14.

Instead of holes (in which case reference is made to screen or multihole nozzles), slot nozzles (for example concentric annular gaps), for example, are also useful.

By virtue of the fact that, in the inventive use of the ejector, the mixing action is effected not least by the gas injected into the stored liquid or into the stored mixture of liquid and fine solid, the ejector in the storage vessel need not, like the jet nozzle, be mounted obliquely upward, nor slightly elevated. Instead, the ejector can be mounted close to the bottom of the storage tank. In addition, the motive nozzle (in the ejector (and hence the ejector as such)) can also be incorporated parallel to the bottom of the storage tank (i.e. normally horizontally) essentially without loss of mixing efficiency. As a result of the horizontal incorporation, the phase interface (the liquid interface) in the storage vessel can be lowered to a significantly lower level before insufficient coverage with liquid is present. In the case of further lowering of the liquid interface down to below the diffusor of the horizontally installed ejector, the horizontal jet leaving the ejector, especially in the case of its previous swirling and/or division, is widened, and, when it hits the vessel wall, generates a reduced amount of spray compared to the jet nozzle. The design (which depends, for example, on the material data of the tank contents and on the tank geometry) of an ejector used to mix the liquid contents of a storage tank can be effected according to the statements made in the document cited. Useful manufacturing materials, adjusted to the properties of the stored liquid/mixture, include both stainless steels and plastics (for example fiber-reinforced plastic matrices, as recommended in EP-A 245844). When the storage contents are acrolein, methacrolein, acrylic acid, methacrylic acid, esters thereof or solutions thereof, a recommended ejector material is in particular stainless steel of DIN material numbers 1.4541 and 1.4547. In principle, the inventive use of an ejector is sufficient for the process according to the invention. Appropriately in accordance with the invention, it is positioned within the vessel such that the exit from the diffusor is in the middle of the vessel. It will be appreciated that it is also possible for a plurality of ejectors to be operated simultaneously in accordance with the invention in one and the same vessel. In this case, appropriately in accordance with the invention, ejectors of equal size will be used. The ejectors may in principle be arranged in any position relative to one another in the tank and, for example, form a star or ball star shape. It is favorable in accordance with the invention that the pump which delivers the motive jet can be identical to the pump to be used for withdrawing the liquid/mixture stored in the vessel (however, it is also possible to use two pumps for the two purposes). In the case of stored liquids comprising (meth)acrylic monomers (or other chemicals stored in liquid form), useful such delivery pumps are, for example, the delivery pumps with double sliding ring seal recommended in WO 2004/003389.

Useful alternative delivery pumps to these are, for example, those of U.S. Pat. No. 5,727,792, U.S. Pat. No. 4,168,936, EP-A 1 092 874 and U.S. Pat. No. 4,865,333.

Figure 8:
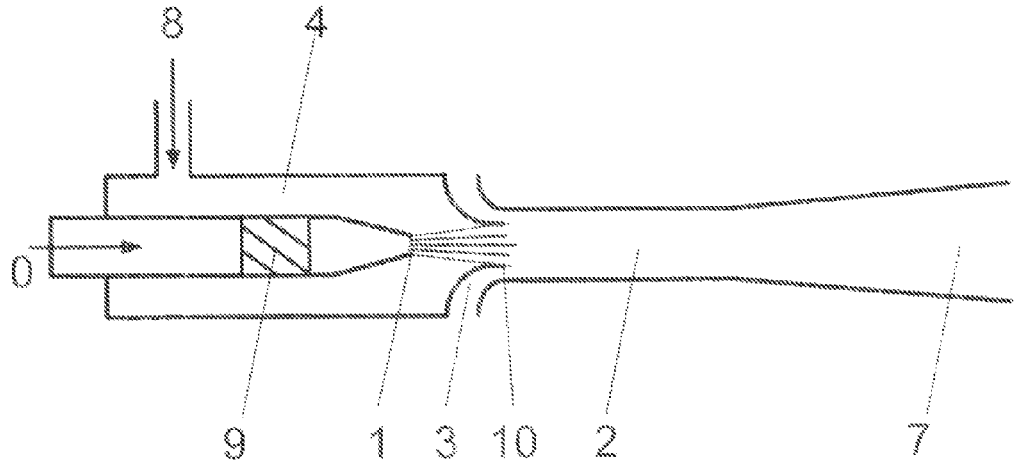
Figure 8 PRIOR ART
FIG. 8 shows an example of an ejector.

The amount of gas sucked in from the gas phase per unit time by means of an ejector for the process according to the invention and (with it, the mixing action) can appropriately be enhanced in accordance with the invention (typically by a factor of from 2 to 3) by combining the advantageousness of the ejector for the process according to the invention with the advantageous features of the jet nozzle acknowledged at the outset of this document (and, for example, also described in DE-A 24 04 289) in a suitable manner to give a so-called ejector jet nozzle as a suction apparatus to be used in accordance with the invention alternatively to the ejector, which is depicted schematically in FIG. 8 (the principle of the ejector jet nozzle is described, for example, in Chemie-ing.-Techn. 47., 1975/No. 5, page 209, in Chemie-Ing.-Techn. MS201/75, in Chemie-ing.-Techn. 61 (1989) No. 11, p. 908 to 909, in DE-A 24 10 570 and in DE-A 15 57 018).

In physical terms, the reason for this is that the gas in the ejector only comes into contact with the liquid of the motive jet, while a multiple of the amount of motive jet is additionally sucked in from the ambient liquid in the momentum exchange chamber of the jet nozzle. Expressed in simplified terms, an ejector jet nozzle is nothing other than a jet nozzle in which the motive jet used is the mixture of sucked-in gas and motive liquid pumped through the motive nozzle of the ejector which forms beyond the motive nozzle of an ejector.

For this purpose, the suction chamber of the ejector part of the ejector jet nozzle does not have a seamless transition into a mixing tube (a mixing chamber) as in the case of the ejector alone. Instead, the suction chamber here is designed to give a mixing nozzle (10) (the suction chamber opens out to a mixing nozzle), from which the mixture of motive liquid and sucked-in gas coming from the "ejector", like the motive jet in the case of a jet nozzle, is ejected into a momentum exchange tube (generally a momentum exchange chamber (open at the inlet and outlet)). In the ejector jet nozzle, the suition chamber generally first has a constant cross section and then opens out in flow direction typically (but not necessarily) to a diffusor (the diffusor has a widening cross section in flow direction). The amount of liquid sucked in as a result from the environment of the mixing nozzle/momentum exchange tube transition in the storage tank per unit time is a multiple (generally from 1 or 2 to 10 times, frequently from 4 to 8 times) the motive liquid pumped into the ejector part per unit time.

The amount of liquid which entrains the sucked-in gas in an ejector jet nozzle overall in flow direction (always per unit time) is thus significantly greater than in the case of a pure ejector. This causes a significantly higher suction force and, for the purposes of the invention, an increased mixing action achievable as a result. Expressed in simplified terms, divided liquid droplets in the mixing tube of an ejector convey a continuous gas phase, while a liquid stream in the momentum exchange tube of the ejector jet nozzle conveys gas bubbles distributed therein.

Advantageously in accordance with the invention, the motive jet nozzle in the ejector part of the ejector jet nozzle also comprises elements which widen and/or divide the motive jet leaving the motive jet nozzle. As already detailed in the description of the jet compressor, useful such elements are, for example, swirl bodies and/or perforated or slotted screens (motive jet dividers). A further advantage of the ejector jet nozzle in comparison to the pure jet compressor is a finer gas distribution which is established, which equally has an advantageous effect on the desired mixing. In summary, in an ejector jet nozzle, the gas sucked in in the ejector part is conducted together with the sucking motive jet into a mixing nozzle and they are mixed together therein. The motive liquid-gas mixture thus obtained is introduced (injected) together into a momentum exchange chamber (at the narrowest cross section thereof) which is disposed in the stored liquid medium, extends in entry direction of the motive liquid-gas mixture and is very small in comparison to the vessel volume (generally, the volume of the momentum exchange chamber is from one hundredth to one hundred thousandth or one millionth of the maximum liquid capacity of the vessel). At the same time, on entry of the motive liquid-gas mixture flowing out of the mixing nozzle (the jet leaving (flowing out) (and leading into the momentum exchange chamber) through the center of the narrowest cross-sectional area of the mixing nozzle in the absence of the stored liquid medium will be referred to in this document as the central jet (see (11) in FIG. 15) leading from the mixing nozzle into the momentum exchange chamber) into the momentum exchange chamber, the stored liquid medium is sucked in from the environment. Owing to the comparatively narrow cross section of the (entry into the momentum exchange chamber) momentum exchange tube, this sucked-in "second" liquid stream is greatly accelerated. As a result of this, a static pressure lowering down to the sucking-in pressure of the gas in the ejector part takes place. At the same time, within fractions of a second after the entry into the momentum exchange chamber, the sucked-in liquid and the motive liquid-gas mixture are mixed highly intensively. This achieves an abrupt change in the disperse phase, so that the result is entrainment of the gas in the form of bubbles distributed finely in the liquid.

The design of an ejector jet nozzle for a specific mixing problem can in turn be effected with reference to the document cited in this document in connection with the ejector jet nozzle (useful construction materials are those mentioned for the ejector).

The speed of the motive liquid on exit from the mixing nozzle will generally be from 10 to 100 m/s, preferably from 15 to 70 or to 30 m/s. The mean diameter of the entry orifice of the momentum exchange chamber will generally be from 1.1 to 4 times, preferably from 1.2 to 2 times, the mean diameter of the mixing nozzle, and the length of the momentum exchange chamber will typically be from 3 to 30 times, preferably from 3 to 10 times, its hydraulic diameter.

The mass flow rate which leaves the momentum exchange chamber typically has a mea momentum density of from 103 to 105 $N/m^2$, preferably from $5 \cdot 10^3$ to $2 \cdot 10^4$ $N/m^2$.

In contrast, the mea momentum density of a motive jet in the process according to the invention is typically from $2.5 \cdot 10^4$ to $10^7$ $N/m^2$, frequently from $10^5$ to $5 \cdot 10^6$ $N/m^2$.

The mean diameter is understood to mean the diameter of a circle which has the same surface area as the cross section in question (which may also be polygonal) of the nozzle or of the entry orifice of the momentum exchange chamber, neither of which need necessarily be circular. The momentum exchange chamber normally has a constant cross section, and the diffusor generally a cross section which is enlarged in flow direction. In principle, the momentum exchange chamber can be constructed in various forms, this form appropriately being adjusted to the form of the mixing nozzle.

In general, the momentum exchange chamber used is generally cylindrical tubes, and the diffusor a frustocone. When the momentum exchange chamber is configured as a cylindrical tube, its length will generally be from 3 to 30 times, preferably from 3 to 10 times, its diameter, which in this case is simultaneously its hydraulic diameter. When the momentum exchange chamber does not have a circular cross section or a constant cross section over its length, its length will normally be from 2 to 30 times, preferably from 3 to 10 times, its hydraulic diameter. The hydraulic diameter is understood to mean the diameter of a cylindrical tube which, with the same throughputs and same length, exhibits the same pressure drop as the momentum exchange chamber in question.

In an ejector jet nozzle suitable in accordance with the invention, the narrowest cross-sectional area of the mixing nozzle will, appropriately from an application point of view, be at a distance from the motive nozzle of the ejector part which corresponds to from 1 to 10 times the narrowest hydraulic diameter of the mixing nozzle.

Moreover, the narrowest cross-sectional area of the mixing nozzle in an ejector jet nozzle suitable in accordance with the invention will, appropriately in accordance with the invention, not project deeper into the momentum exchange chamber (normally centered) than the extent which corresponds to from ≥0 to 3 or to 2 times the narrowest hydraulic diameter of the motive nozzle.

Advantageously in accordance with the invention, the mixing nozzle projects into the momentum exchange chamber. In principle, the narrowest cross-sectional area of the mixing nozzle to the entry into the momentum exchange chamber may also have a distance which may be, for example, up to 1 time or more times the narrowest hydraulic diameter of the motive nozzle.

Moreover, the narrowest cross-sectional area of the mixing nozzle of an ejector jet nozzle suitable in accordance with the invention, advantageously from an application point of view, will have from 1.5 to 15 times, preferably from 2 to 10 times, the narrowest motive nozzle cross-sectional area. The speed of the motive jet leaving the motive nozzle in the ejector part is, in a manner suitable in accordance with the invention in an ejector jet nozzle, generally from 20 to 50 m/s.

The statements made here on the possible dimensioning of the ejector part of the ejector jet nozzle also apply to an ejector alone.

Instead of only one ejector jet nozzle, it is also possible to use for the process according to the invention, as already mentioned in the case of use of pure ejectors, a plurality of (a bundle of) ejector jet nozzles in one and the same storage vessel. As in the case of the ejector too, it may be appropriate in accordance with the invention (especially to avoid deposits of fine solids in mixtures to be stored in accordance with the invention) to mount the ejector jet nozzle (or the ejector) in the middle of the vessel pointing vertically downward. It is also possible in accordance with the invention, in the case of one ejector jet nozzle, to combine a plurality of ejector parts comprising their mixing nozzle with a combined momentum exchange chamber, in which case its entry orifice cross section should correspond to the sum of the cross section required for the particular mixing nozzle in the case of its individual use.

In principle, the momentum exchange chamber and the ejector part, also comprising the mixing nozzle, of an ejector jet nozzle may be connected to one another via connecting elements (preferably via three connecting elements (enable completely satisfactory centering), of which in each case two enclose an angle of 120°). However, they may also be screwed into one another. In this case, slots mounted appropriately permit the sucking-in of the ambient liquid.

Typically, in the case that the process according to the invention is practised with an ejector jet nozzle, the ratio of total liquid volume conducted into the momentum exchange chamber to gas volume supplied may be in the range from 0.1 to 10.

Momentum exchange in the momentum exchange chamber and conversion of the kinetic energy to pressure energy in the diffusor results in static pressure buildup in the ejector jet nozzle. This compressing operation takes place owing to the greater amount of liquid with a better efficiency than in the case of ejectors. Another advantageous factor is that the flow losses as a result of wall friction in the momentum exchange chamber, which generally has a larger diameter compared to the mixing chamber of customary ejectors, under otherwise identical conditions are smaller owing to the lower flow rate.

Figure 9:
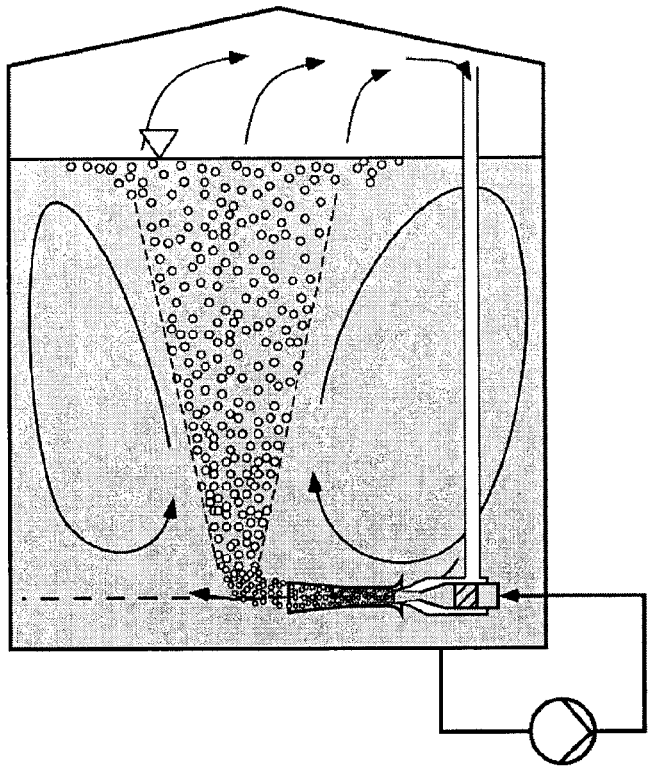
FIG. 9 shows an example of a gas-induced mixing tank filled with a liquid or with a mixture or a liquid and a fine solid using a preferred ejector jet nozzle as a suction apparatus.
Figure 10:
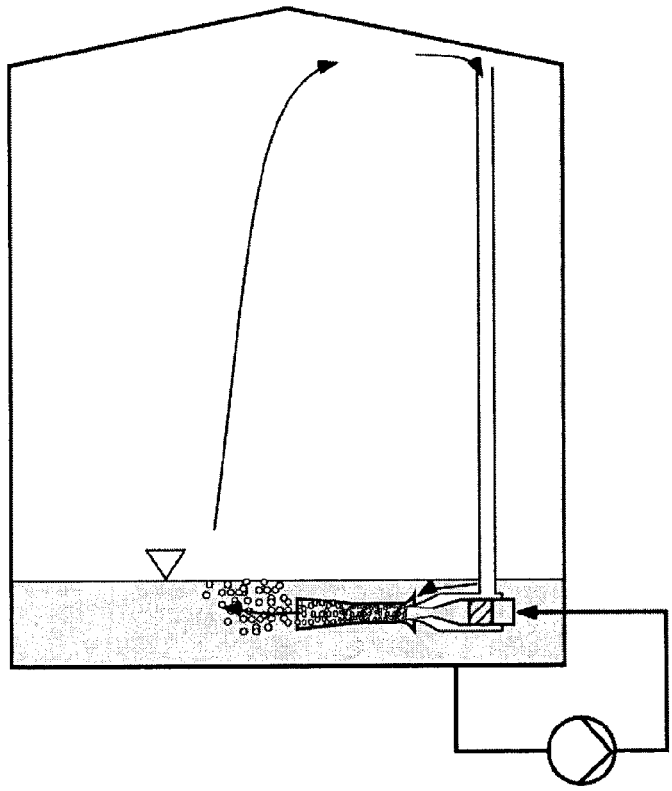
FIG. 10 shows an example of installing the ejector jet horizontally.
Figure 11:
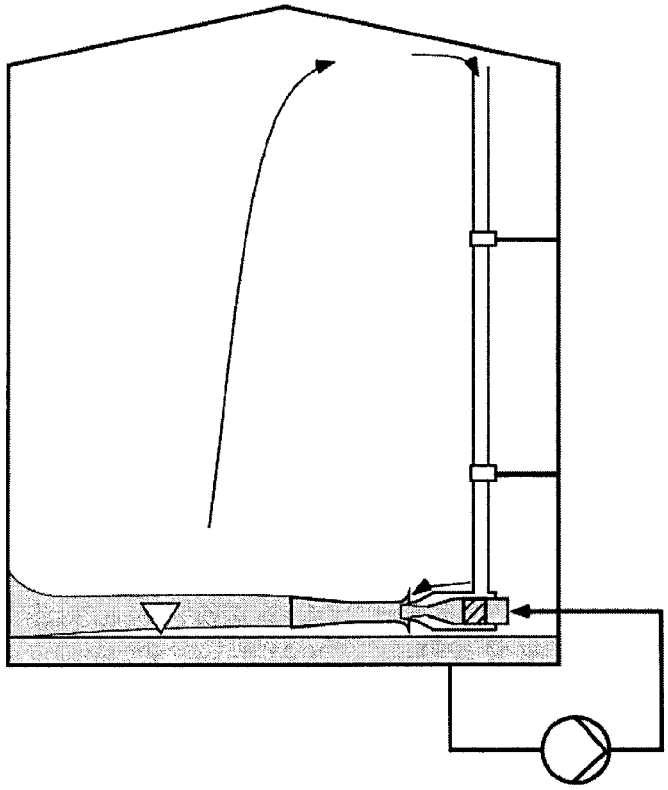
FIG. 11 shows an example of installing the ejector jet horizontally.

FIG. 9 of this document shows a schematic of an embodiment of an inventive primarily gas-induced mixing of a tank filled with a liquid or with a mixture of a liquid and a fine solid using a preferred ejector jet nozzle as a suction apparatus. The possibility of installing the ejector jet nozzle horizontally allows the liquid interface (the phase interface), according to FIG. 10, to be lowered to a comparatively low level before there is insufficient covering with liquid. In the case of further lowering of the liquid interface (phase interface) to below the nozzle, no further additional liquid is sucked in. However, the jet leaving horizontally no longer generates a significant amount of spray when it hits the vessel wall (especially in the case of additional use of a swirl body upstream of the motive nozzle in the ejector part) (FIG. 11), since it no longer reaches the vessel wall as a bundled jet.

Figure 12:
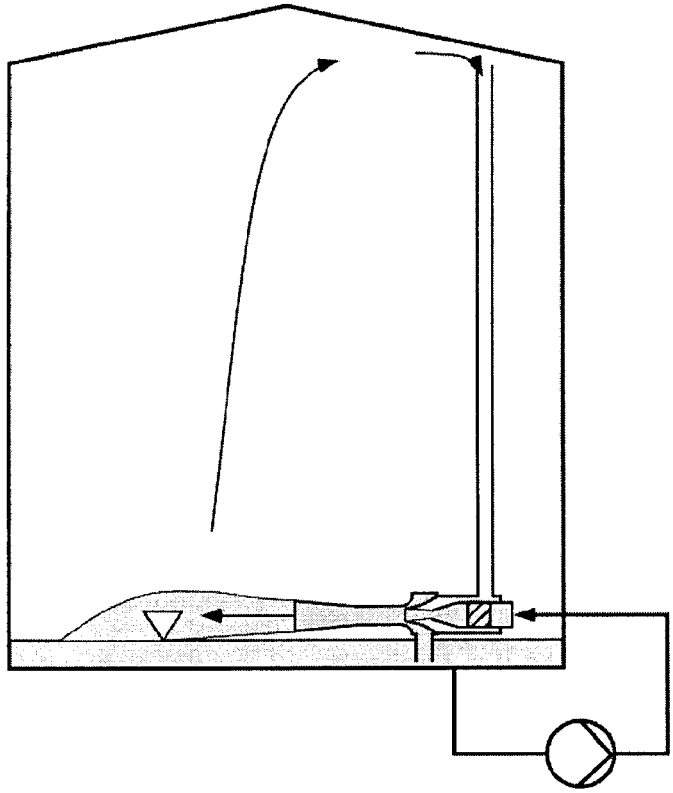
FIG. 12 shows an example of an ejector nozzle in which the suction region between the mixing nozzle and the momentum exchange chamber is provided with a sheath having at least one orifice.

In an embodiment particularly preferred in accordance with the invention, the suction apparatus used for the process according to the invention, according to FIG. 12, may also be an ejector jet nozzle in which the suction region (for the ambient liquid) between mixing nozzle and momentum exchange chamber (momentum exchange tube) is provided with a sheath having at least one orifice (at least one entry orifice (at least one suction orifice)), with the proviso that the at least one orifice is below (here, below means proceeding from the central jet in the direction of the vessel or tank bottom) the central jet leaving from the mixing nozzle into the momentum exchange chamber. This at least one entry orifice is most preferably designed as an immersed tube (opening out) leading in the direction of the vessel bottom, and is thus disposed close to the vessel bottom (this causes particularly rapid mixing owing to the suction from below). In principle, the cross section of the immersed tube may be as desired, i.e. circular, oval or polygonal. Normally, the cross section of the immersed tube in the process according to the invention is constant over its length. Immersed tubes with circular cross section are preferred in accordance with the invention. The mean diameter of the at least one suction orifice below the central jet leading from the mixing nozzle into the momentum exchange chamber will normally be from 1 to 20 times, preferably from 2 to 10 times, the mean diameter of the mixing nozzle. Generally, the immersed tube is configured in such a way that flow through it causes a minimum pressure drop. In principle, the at least one suction orifice can also be designed as holes and/or slots distributed in the wall of the immersed tube over its length. The immersed tube may also, at its end disposed close to the bottom, be curved upward like a meat hook, so that the suction orifice does not point toward the vessel bottom but rather toward the vessel roof (cover). The curve may also be designed like a golf club and open out with the suction orifice parallel to the vessel bottom. In addition, the immersed tube including suction orifice may project into a pot which is open at the top and rests on the vessel bottom. It is also favorable that the suction orifice of the immersed tube and the outlet from the momentum exchange chamber (tube) can be positioned in spatial terms independently of one another (for example at a maximum distance from one another) (are no longer necessarily correlated with one another in their spatial position). The embodiment with immersed tube (this can be welded seamlessly to the sheath, or screwed into the sheath, or be bonded to an appropriate connection disposed in the sheath (for example flanged onto a connecting stub)) still permits, even in the case of extremely low fill level in the storage vessel, essentially virtually unimpaired performance of the process according to the invention. At worst, this becomes problematic when the delivery pump is briefly switched off. In this case, the immersed tube is no longer filled toward the mixing nozzle with the stored liquid or the stored mixture of liquid and fine solid, but rather with gas. In the case of sufficient swirling and/or division of the motive jet of the motive nozzle (for example by means of a swirl body and/or of a motive jet divider and/or of a tangential feed of the motive jet) in the ejector part of the ejector jet nozzle, the resulting suction force is, however, sufficient in order to raise the liquid or mixture level in the immersed tube to the required degree immediately after the restart, and to be able to continue the inventive procedure.

The volume of the gas phase in the vessel in the process according to the invention should be at least 5% by volume, or at least 10% by volume, of the liquid or mixture volume stored in the vessel. However, on the same basis, it may also be 30% by volume, 60% by volume, 90% by volume, 150% by volume, 250% by volume, 350% by volume and more.

Moreover, it is favorable in accordance with the invention when at least about $10^{-5}$ standard liter (gas volume at 0° C. and 1 atm in the unit of liters) of gas (but normally not more than one $10^{-1}$ standard liter) is injected per minute per liter of liquid contents of the storage vessel in the process according to the invention.

The vessel itself advantageously has cylindrical (for example with circular or square or rectangular cross section) structure which is concluded at the top by a conical roof or by a hemispherical or dome-shaped roof.

The process according to the invention is suitable in particular for the advantageous storage of all liquids mentioned at the outset of this document (but also, for example, of benzene, toluene, alcohols, other hydrocarbons) or mixtures of a liquid and a fine solid. These are generally shipped blanketed with a gas which is saturated with the vapor of the liquid (i.e. the gas phase typically does not consist only of evaporated liquid). Useful such gases include, for example, inert gases such as $N_2$, noble gases, for example Ar, and/or $CO_2$.

It will be appreciated that such gases may also be air, or other mixtures of molecular oxygen and inert gas. The absolute pressure in the tank may, for example, be from atmospheric pressure to 50 bar; the temperature in the tank may, for example, be from 0 (or less) to 100 (or more)° C.

Neither of the two aforementioned parameters is subject to any resctriction in the process according to the invention.

The process according to the invention is particularly advantageous when the stored liquid is at least one monoethylenically unsaturated organic compound (for example N-vinylformamide, vinyl acetate, esters of maleic acid, styrene and/or N-substituted acrylamides) or a solution comprising at least one such monoethylenically unsaturated organic compound, especially when it comprises an added polymerization inhibitor for the purpose of inhibiting undesired free-radical polymerizations.

Further examples of such at least monoethylenically unsaturated organic compounds include acrolein, methacrolein, acrylic acid, methacrylic acid and esters of acrylic acid and/or methacrylic acid and mono- or polyhydric alkanols. These esters include in particular those whose alcohol has from one to twenty carbon atoms, or from one to twelve carbon atoms, or from one to eight carbon atoms. Exemplary representatives of such esters include methyl acrylate, ethyl acrylate, n-butyl acrylate, isobutyl acrylate, tert-butyl acrylate, 2-ethylhexyl acrylate, hydroxyethyl acrylate, hydroxypropyl acrylate, hydroxyethyl methacrylate, hydroxypropyl methacrylate, methyl methacrylate, ethyl methacrylate, n-butyl methacrylate and tert-butyl methacrylate. Useful inhibitors of free-radical polymerizations for the aforementioned monomers and their solutions in organic or aqueous solvents are, for example, the monomethyl ether of hydroquinone (MEHQ), hydrochinones, phenols (e.g. 2,4-dimethyl-6,6-butylphenol), quinones, butylpyrocatechol, phenothiazine, diphenylamine, p-phenylenediamines, nitroxyl radicals and/or nitroso compounds, for example nitrophenols (and also all other polymerization inhibitors mentioned in WO 00/64947). Based on the monomer content, the amount of polymerization inhibitors added for the purpose of storage may be from 0.5 to 1000 ppm by weight (frequently from 1 to 600 ppm by weight or from 2 to 500 ppm by weight).

In the case of glacial acrylic acid (acrylic acid content ≥99.5% by weight), generally 200±20 ppm by weight of MEHQ are added as a storage inhibitor (storage temperature recommendation: 15 to 25° C.). In the case of n-butyl acrylate (n-butyl acrylate content ≥99.5% by weight) and the other (meth)acrylic esters, generally 15±5 ppm by weight of MEHQ are added as a storage stabilizer (storage temperature recommendation: 20 to 35° C.). MEHQ is also the preferred storage stabilizer for the other (meth)acrylic monomers mentioned and solutions thereof.

As already mentioned, aforementioned polymerization inhibitors (especially MEHQ) display their full inhibiting action generally only in the presence of molecular oxygen. However, especially (meth)acrylic monomers are capable of forming explosive mixtures with molecular oxygen.

In order to rule out a corresponding explosion even in the case of spray (spray formation) in the storage tank, it has been necessary to date either to prevent such spray formation by means of a liquid level control which is widely available from a safety technology point of view, or to correspondingly restrict the oxygen content of the gas phase in the storage tank, as recommended in WO 2005/049543 in the context of U.S. Pat. No. 6,910,511.

The use of the inventive procedure, with whose aid it is possible to prevent spray formation even with a relatively low liquid level in the vessel, permits, in comparison, the comparatively simple and reliable blanketing of the tank contents with air saturated with the liquid stored in the tank. When, however, the stored acrylic acid (the stored acrolein) is acrylic acid (acrolein) which has been obtained by heterogeneously catalyzed partial gas phase oxidation of propylene in the presence of propane or by heterogeneously catalyzed partial gas phase oxidation of propane itself, the crude acrylic acid to be stored (the crude acrolein to be stored), after its removal from the product gas mixture, is generally obtained in a form saturated with propane. In this case, the gas mixture additionally comprises combustible propane. For safe storage, it is advisable in this case to comply with the lower limit in the limiting oxygen concentration by storage under lean air according to WO 2005/049543 in the gas phase.

In principle, with decreasing fill level in the storage vessel in the process according to the invention, the feed (recycle) rate to form the motive jet can be reduced.

Quite generally, the introduction of molecular oxygen into the liquid to be stored or into the mixture to be stored in the process according to the invention is made very simple.

The process according to the invention is suitable, for this reason too among others, especially for storage tanks with particularly large tank contents.

The present application thus comprises in particular the following inventive embodiments:

EMBODIMENTS

1. A process for mixing a liquid or mixture of a liquid and a fine solid present in an essentially self-contained vessel, with the proviso that the liquid or mixture fills only part of the internal volume of the vessel occupiable by a fluid phase, and the remaining occupiable internal volume of the vessel is filled by a gas phase, comprising supply of essentially the same liquid or essentially the same mixture into the vessel as a motive jet of a suction apparatus disposed in the liquid or in the mixture in the vessel, wherein the suction apparatus, with the aid of the motive jet, sucks in gas from the gas phase present in the vessel and releases the sucked-in gas together with the motive jet into the liquid or mixture present in the vessel.
2. A process according to embodiment 1, wherein the suction apparatus comprises at least one ejector which has a motive nozzle and a suction chamber which is connected to the gas phase (via a connection through which the gas can be sucked in from the gas phase), and through whose motive nozzle the motive jet is conducted.
3. A process according to embodiment 2, wherein a swirling motion is imparted to the motive jet before it passes through the motive nozzle.
4. A process according to embodiment 3, wherein the swirling motion is imparted with a swirl body installed upstream of the motive nozzle.
5. A process according to embodiment 3, wherein the swirling motion is imparted by supplying the motive liquid to the motive nozzle tangentially.
6. A process according to any of embodiments 1 to 5, wherein the motive jet is divided as it passes through the motive nozzle.
7. A process according to embodiment 6, wherein the motive nozzle is a screen nozzle or a slot nozzle.
8. A process according to embodiment 1, wherein the suction apparatus comprises at least one ejector jet nozzle which has a motive nozzle, a suction chamber which surrounds the motive nozzle and opens out into a mixing nozzle, and a momentum exchange chamber into which the outlet of the mixing nozzle points, the suction chamber being connected to the gas phase (via a connection through which the gas can be sucked in from the gas phase), and the motive jet (in a mixture with the sucked-in gas) being conducted through its motive nozzle via the mixing nozzle into the momentum exchange chamber.

9. A process according to embodiment 8, wherein a swirling motion is imparted to the motive jet before it passes through the motive nozzle.
10. A process according to embodiment 9, wherein the swirling motion is imparted with a swirl body installed upstream of the motive nozzle.
11. A process according to embodiment 9, wherein the swirling motion is imparted by supplying the motive liquid to the motive nozzle tangentially.
12. A process according to any of embodiments 8 to 11, wherein the motive jet is divided as it passes through the motive nozzle.
13. A process according to embodiment 12, wherein the motive nozzle is a screen nozzle or a slot nozzle.
14. A process according to any of embodiments 1 to 7, wherein the ejector is installed horizontally into the vessel.
15. A process according to any of embodiments 8 to 13, wherein the ejector jet nozzle is installed horizontally into the vessel.
16. A process according to any of embodiments 8 to 13 and 15, wherein the transition from the mixing nozzle into the momentum exchange chamber is provided with a sheath having at least one orifice, with the proviso that the at least one orifice is below the central jet (11) leading from the mixing nozzle into the momentum exchange chamber.
17. A process according to any of embodiments 8 to 13 and 15, wherein the transition from the mixing nozzle into the momentum exchange chamber is provided with a sheath which has at least one orifice which opens out to an immersed tube leading in the direction of the vessel bottom.
18. A process according to any of embodiments 1 to 17, wherein the liquid comprises at least one of the organic compounds from the group comprising acrolein, methacrolein, acrylic acid, methacrylic acid, esters of acrylic acid and esters of methacrylic acid.
19. A process according to any of embodiments 1 to 17, wherein the liquid comprises N-vinylformamide.
20. A process according to embodiment 18 or 19, wherein the liquid comprises at least one dissolved polymerization inhibitor.
21. A process according to any of embodiments 1 to 20, wherein the gas phase comprises molecular oxygen.
22. A process according to any of embodiments 1 to 21, wherein the volume of the gas phase in the vessel is at least 5% by volume of the liquid or mixture volume stored in the vessel.
23. A process according to any of embodiments 1 to 22, wherein at least $10^{-5}$ standard liter of gas per minute per liter of liquid or mixture of liquid and fine solid present in the vessel is sucked out of the gas phase and released into the liquid or mixture present in the vessel.
24. A process according to any of embodiments 1 to 23, wherein the liquid or mixture fed into the vessel as a motive jet comprises a portion or the entirety of a portion of the liquid or mixture present in the vessel which has been withdrawn beforehand from the vessel.
25. A process according to any of embodiments 1 to 23, wherein the liquid or mixture fed into the vessel as a motive jet does not comprise a portion of the liquid or mixture present in the vessel which has been withdrawn beforehand from the vessel.
26. A process according to any of embodiments 1 to 25, wherein the liquid or mixture fed into the vessel as a motive jet has been conducted through a heat exchanger beforehand.
27. A vessel comprising, as well as a gas phase, a liquid or a mixture of a liquid and a fine solid, and also at least one ejector which comprises a motive jet and a suction chamber which has a connection (through which the gas can be sucked in from the gas phase) to the gas phase.
28. A vessel comprising, as well as a gas phase, a liquid or a mixture of a liquid and a fine solid, and also at least one ejector jet nozzle which has a motive nozzle, a suction chamber which surrounds the motive nozzle and opens out into a mixing nozzle, and a momentum exchange chamber into which the outlet of the mixing nozzle points, and a connection (through which the gas can be sucked in from the gas phase) to the gas phase.
29. The use of an ejector for the gas-induced mixing of a liquid or mixture of a liquid and a fine solid present in an essentially self-contained vessel, with the proviso that the liquid or mixture fills only part of the internal volume of the vessel occupiable by a fluid phase, and the remaining occupiable internal volume of the vessel is filled by a gas phase.
30. The use of an ejector jet nozzle for the gas-induced mixing of a liquid or mixture of a liquid and a fine solid present in an essentially self-contained vessel, with the proviso that the liquid or mixture fills only part of the internal volume of the vessel occupiable by a fluid phase, and the remaining occupiable internal volume of the vessel is filled by a gas phase.
31. An ejector jet nozzle which has a motive nozzle, a suction chamber which surrounds the motive nozzle and opens out into a mixing nozzle, and an impulse exchange chamber into which the outlet of the mixing nozzle points, wherein the transition from the mixing nozzle into the impulse exchange chamber is provided with a sheath, and the sheath has at least one connection for an immersed tube or at least one immersed tube leading into the sheath, The process according to the invention is also suitable for very rapidly mixing another liquid or another mixture into a liquid or mixture of a liquid and a fine solid present in an essentially self-contained vessel, with the proviso that the liquid or mixture fills only part of the internal volume of the vessel occupiable by a fluid phase and the remaining occupiable internal volume of the vessel is filled by a gas phase (and also irrespective of the given fill level in the vessel).

In this case, the procedure in the simplest manner is that the mixture or liquid to be supplied as the motive jet in accordance with the invention is exclusively the other liquid or other mixture to be mixed in. In order to further promote the formation of a homogeneous mixture in the vessel on completion of supply of the other liquid or the other mixture, appropriately in accordance with the application, a portion of the total amount of liquid or mixture which is then present in the vessel will then be withdrawn therefrom, for example with the pump available for vessel withdrawal, and at least some of the portion withdrawn (if appropriate after it has been conducted through a heat exchanger) will be recycled as the motive jet of a suction apparatus which is present in the liquid or in the mixture in the vessel and is to be used in accordance with the invention into the vessel.

Alternatively, the procedure may also be to initially use a mixture of the other liquid or the other mixture and a portion of the liquid or mixture present therein which has been withdrawn beforehand as the motive jet of the suction apparatus to be used in accordance with the invention. In order to further promote the formation of a homogeneous mixture in the vessel on completion of supply of the total amount of the other liquid or the other mixture to be supplied, appropriately in accordance with the application, a portion of the total amount of liquid or mixture which is then present in the vessel will then be withdrawn therefrom, for example with the pump available for vessel withdrawal, and at least some of the portion withdrawn (if appropriate after it has been conducted through a heat exchanger) will be recycled as the motive jet of a suction apparatus which is present in the liquid or in the mixture in the vessel and is to be used in accordance with the invention into the vessel.

If appropriate, on completion of supply of the total amount of the other liquid or of the other mixture supplied, the formation of a homogeneous mixture in the vessel can also be promoted further by supplying essentially the same liquid or mixture as a motive jet without having withdrawn it from the vessel beforehand.

When the liquid present in the vessel, or the liquid of the mixture present in the vessel, is one which already comprises at least one compound having at least one ethylenically unsaturated moiety (for example acrolein, methacrolein, acrylic acid, methacrylic acid, esters of acrylic acid and/or esters of methacrylic acid) (generally in a form stabilized by adding polymerization inhibitors), there may be undesired free-radical polymerization for various reasons. In order to stop such an undesired free-radical polymerization very rapidly before it becomes more marked, the essentially immediate mixing of highly concentrated solutions of free-radical polymerization inhibitors (cf. WO 00/64947, WO 99/21893, WO 99/24161, WO 99/59717) is recommended in the prior art.

Such solutions may, for example, be a liquid to be mixed in in accordance with the invention as described above. In particular, such "short stop solutions" may be inhibitor solutions which comprise at least 10% by weight of phenothiazine, from 5 to 10% by weight of p-methoxyphenol and at least 50% by weight of N-methylpyrrolidone.

Alternatively, all other "short stop solutions" recommended in the aforementioned WO documents are useful.

The present patent application therefore additionally comprises the following inventive embodiments:

32. A process for mixing another liquid or another mixture into a liquid or mixture of a liquid and a fine solid present in an essentially self-contained vessel, with the proviso that the liquid or mixture fills only part of the internal volume of the vessel occupiable by a fluid phase and the remaining occupiable internal volume of the vessel is filled by a gas phase, comprising supply of the other liquid or the other mixture into the vessel as a motive jet of a suction apparatus present in the liquid or in the mixture in the vessel, wherein the suction apparatus, with the aid of the motive jet, sucks in gas from the gas phase present in the vessel, and releases the sucked-in gas, together with the motive jet, into the liquid or mixture present in the vessel.

33. A process according to embodiment 32, wherein the liquid present in the vessel comprises a compound having at least one ethylenically unsaturated moiety, and the other liquid supplied as a motive jet is an inhibitor solution which comprises at least 10% by weight of phenothiazine, from 5 to 10% by weight of p-methoxyphenol and at least 50% by weight of N-methylpyrrolidone.

WORKING EXAMPLE

In an outdoor tank (wall thickness: 5 mm, manufacturing material: DIN 1.4541) stainless steel) according to FIG. 13 (cylindrical footprint with a diameter of 8.5 m and a height of 10 m up to the start of the conical roof), glacial acrylic acid (GAA) stabilized with 200 ppm by weight of MEHQ was stored at a desired internal temperature of 20° C. under atmospheric pressure at maximum fill height. The maximum fill height in the storage tank was 9 m. The gas volume remaining at maximum fill height was 69 $m^3$.

The withdrawal from the tank was effected by means of a CPK 50-200 centrifugal pump from KSB Aktiengesellschaft in D-67227 Frankenthal.

The barrier fluid present in the pump with double slip ring seal was a mixture of ethylene glycol and water. The glacial acrylic acid in the storage tank was covered by means of air. By means of an offgas system which was open to the atmosphere via a flare (orifice cross section in the conical roof=20 $cm^2$), it was possible to release gas from the gas phase of the tank to a flare in the course of filling for pressure release.

Figure 13:
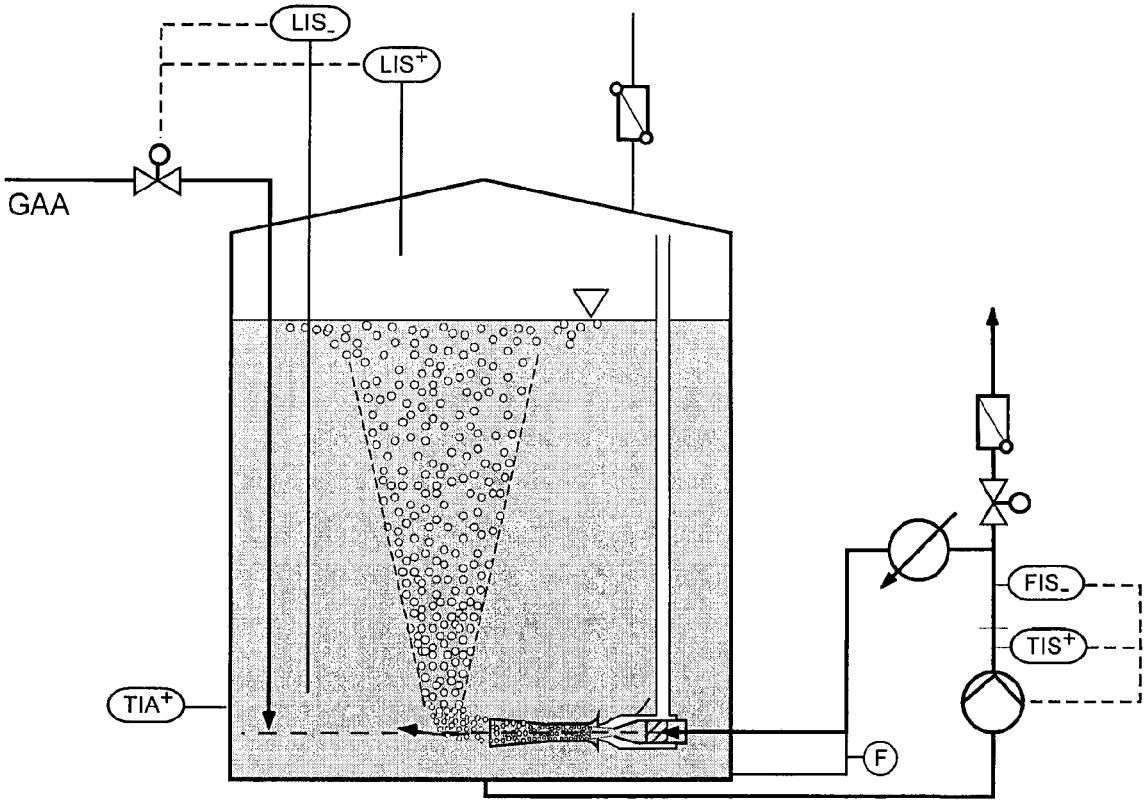
FIG. 13 shows an example of an outdoor tank.
Figure 14:
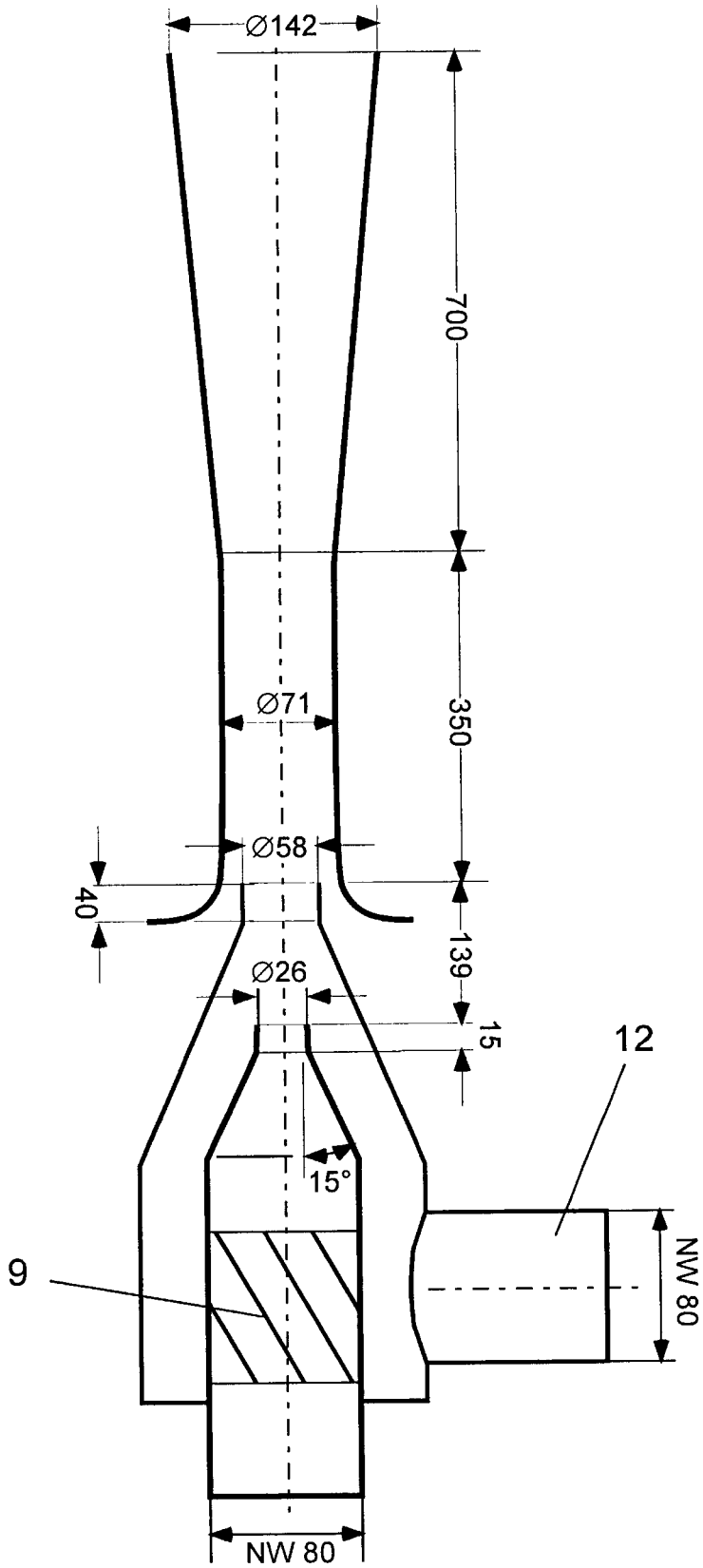
FIG. 14 shows and example of an ejector jet nozzle.
Figure 15:
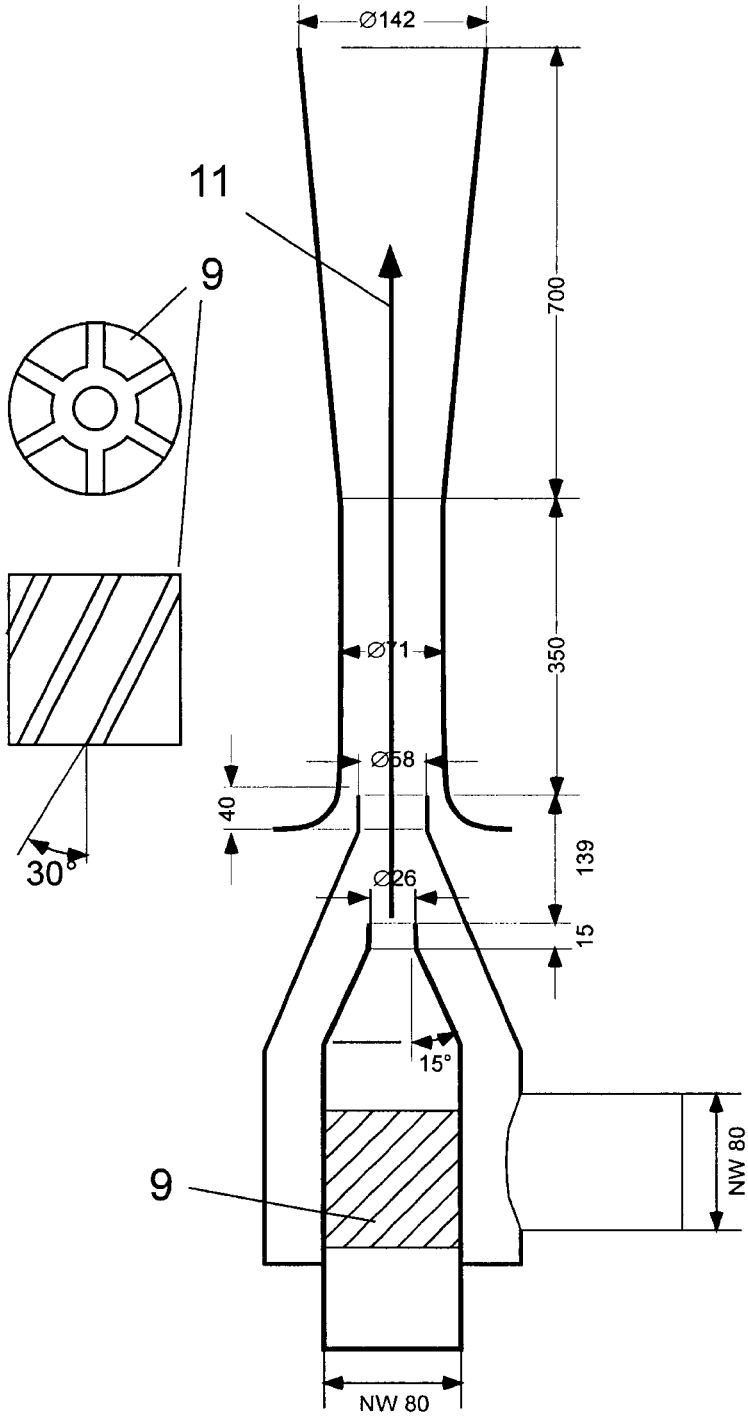
FIG. 15 shows an example shows of a swirl body disposed upstream of the motive nozzle of the ejector part.

In a corresponding manner, air was replenished via a pressure-retaining device for pressure equalization in the course of withdrawal of glacial acrylic acid from the tank. Close to the bottom, as can be seen in FIG. 13, the ejector jet nozzle (manufactured from DIN-1.4541 stainless steel) from FIG. 14 was mounted horizontally in such a way that the diffusor thereof projected into about the middle of the tank The dimensions in FIG. 14 are the accompanying dimensions (nominal widths) of the ejector jet nozzle in mm and angles in degrees (NW stands for nominal width). The wall thicknesses were from 1 to 6 mm. FIG. 15 additionally shows the swirl body disposed upstream of the motive nozzle of the ejector part from the side and from the front, and the swirl angle which was 300. FIG. 14 also shows the connection (12) of the riser tube projecting into the gas phase of the tank to the suction chamber of the ejector part of the ejector jet nozzle.

The centrifugal pump was used to withdraw 40 $m^3$/h of glacial acrylic acid continuously from the tank over a period of 1 week, and to recycle it as the motive jet into the ejector jet nozzle via the heat exchanger in FIG. 13. Irrespective of the external temperature (which varied within the range of ±15° within the experimental period), the temperature was kept constant within the range of 20±1° C. at the withdrawal point of the storage tank.

Finally, 1 l of a 0.1% by weight solution of phenothiazine in glacial acrylic acid was introduced all at once into the tank from the top (at maximum fill height). After 5 minutes, the concentration of equal distribution of the added phenothiazine had arrived within the range of ±10% about its theoretical value at the withdrawal point.

Subsequently, the recycle rate was retained, but the withdrawal rate was increased by 20 $m^3$/h, i.e. the tank was emptied by 20 $m^3$/h. It was possible without any problem to withdraw 99% of its liquid contents from the tank without spray being formed in the tank (in principle, it was also possible to withdraw glacial acrylic acid from the tank via an outlet which did not lead through the circulation pump).

Figure 16:
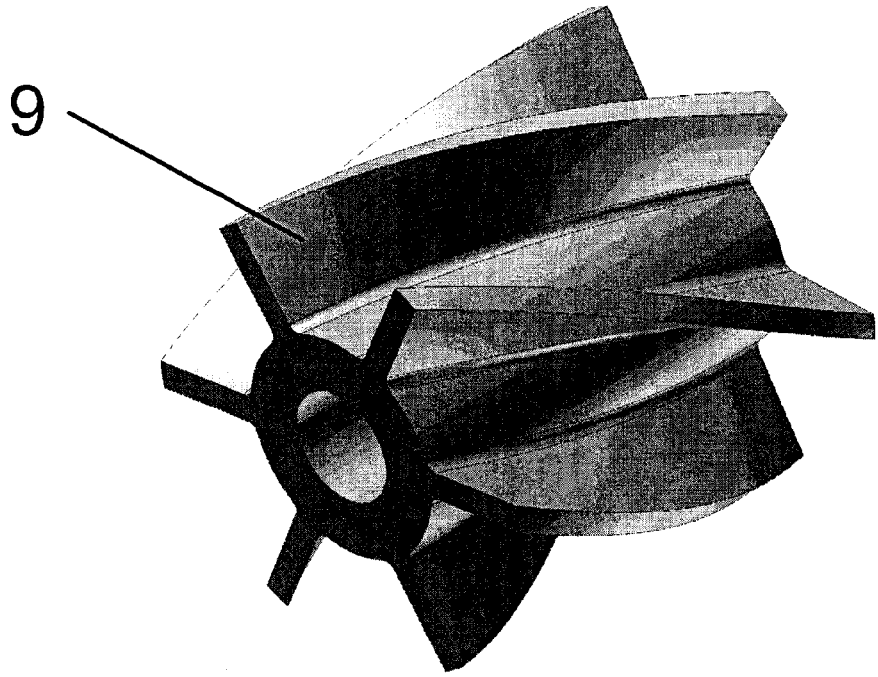
FIG. 16 shows a three dimensional example of a swirl body.

FIG. 16 additionally shows the three-dimensional diagram of the swirl body used.

Figure 17:
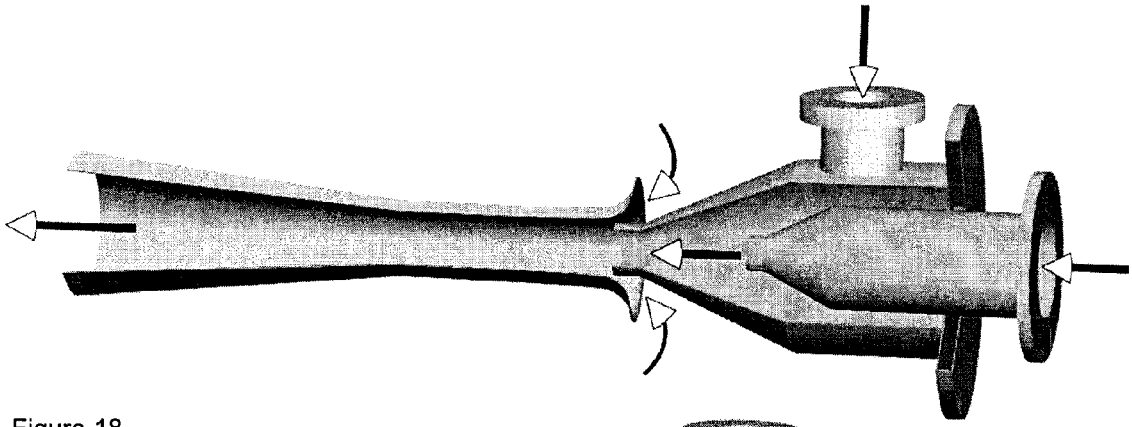
FIG. 17 shows a three dimensional example of the ejector nozzle.
Figure 18:
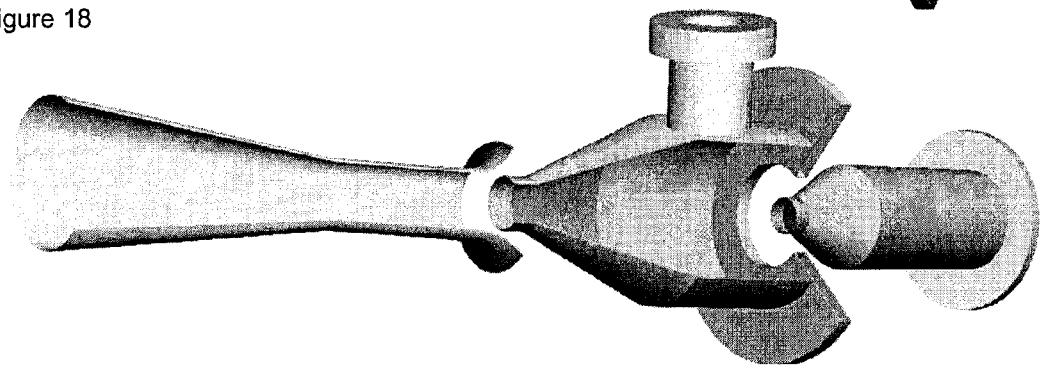
FIG. 18 shows a three dimensional exploded diagram example of the ejector nozzle.

FIG. 17 shows, for illustration, a three-dimensional diagram of the ejector jet nozzle (in section), and FIG. 18 shows the corresponding exploded diagram.

In addition, the abbreviations in FIG. 13 stand for:

$TIA^+$ for "temperature indicator alarm";

LIS for *level indicator switch"; as overfill protection (+) and as underfill protection (−);

$TIS^+$ for "temperature indicator security";

FIS for "flow indicator security";

F for "flow" (small safety flow as pump protection).

In addition, FIG. 13 shows, on the vessel roof, a two-way non-return valve and, beyond the pump but upstream of the withdrawal, a single-action (only opening outward) non-return valve.

U.S. Provisional Patent application No. 60/846,095, filed on Sep. 21, 2006, is incorporated into the present application by literature reference. With regard to the above-mentioned teachings, numerous changes and deviations from the present invention are possible. It can therefore be assumed that the invention, within the scope of the appended claims, can be performed differently from the way specifically described herein.

The invention claimed is:

1. A process for mixing a liquid or mixture of a liquid and a fine solid stored in a storage tank, said storage tank comprising a gas suction apparatus and a motive jet of essentially the same liquid or essentially the same mixture supplied in the storage tank, wherein said gas suction apparatus is disposed entirely in the liquid or mixture of a liquid and a fine solid, with the proviso that the liquid or mixture of a liquid and a fine solid fills only part of the internal volume of the storage tank occupiable by a fluid phase, and the remaining occupiable internal volume of the storage tank is filled by a gas phase, wherein the gas suction apparatus, with the aid of the motive jet, sucks in gas from the gas phase stored in the storage tank and releases the sucked-in gas together with the motive jet into the liquid or mixture of a liquid and a fine solid in the storage tank, wherein the gas phase comprises molecular oxygen, and said gas phase is recycled from said suction apparatus through said liquid or mixture of a liquid and a fine solid and returned to said gas phase;

the liquid comprises at least one organic compound from the group consisting of N-vinylformamide, acrolein, methacrolein, acrylic acid, methacrylic acid, esters of acrylic acid and ester of methacrylic acid;

the liquid comprises at least one dissolved polymerization inhibitor, at least $10^{-5}$ standard liter of gas per minute per liter of liquid or mixture of liquid and fine solid stored in the storage tank is sucked out of the gas phase and released into the liquid or mixture stored in the storage tank; and ≤1% by volume of the gas which is sucked out of the gas phase and is released into the liquid or mixture stored in the storage tank together with the motive jet is chemically changed as it is bubbled upwards once through the stored liquid or mixture.

2. The process according to claim 1, wherein the gas suction apparatus comprises at least one ejector which has a motive nozzle and a suction chamber which is connected to the gas phase, and through whose motive nozzle the motive jet is conducted.

3. The process according to claim 2, wherein a swirling motion is imparted to the motive jet before it passes through the motive nozzle.

4. The process according to claim 3, wherein the swirling motion is imparted with a swirl body installed upstream of the motive nozzle.

5. The process according to claim 3, wherein the swirling motion is imparted by supplying the motive liquid to the motive nozzle tangentially.

6. The process according to claim 2, wherein the motive jet is divided as it passes through the motive nozzle.

7. The process according to claim 6, wherein the motive nozzle is a screen nozzle or a slot nozzle.

8. The process according to claim 1, wherein the gas suction apparatus comprises at least one ejector jet nozzle, which has a motive nozzle, a suction chamber which surrounds the motive nozzle an opens out into a mixing nozzle, and a momentum exchange chamber into which the outlet of the mixing nozzle points, the suction chamber being connected to the gas phase and the motive jet being conducted through its motive nozzle via the mixing nozzle into the momentum exchange chamber.

9. The process according to claim 8, wherein a swirling motion is imparted to the motive jet before it passes through the motive nozzle.

10. The process according to claim 9, wherein the swirling motion is imparted with a swirl body installed upstream of the motive nozzle.

11. The process according to claim 9, wherein the swirling motion is imparted by supplying the motive liquid to the motive nozzle tangentially.

12. The process according to claim 8, wherein the motive jet is divided as it passes through the motive nozzle.

13. The process according to claim 12, wherein the motive nozzle is a screen nozzle or a slot nozzle.

14. The process according to claim 2, wherein the ejector is installed horizontally into the storage tank.

15. The process according to claim 8, wherein the ejector jet nozzle is installed horizontally into the storage tank.

16. The process according to claim 8, wherein the transition from the mixing nozzle into a momentum exchange chamber is provided with a sheath having at least one orifice, with the proviso that the at least one orifice is below the central jet leading from the mixing nozzle into the momentum exchange chamber.

17. The process according to claim 8, wherein the transition from the mixing nozzle into the momentum exchange chamber is provided with a sheath which has at least one orifice which opens out to an immersed tube leading in the direction of the storage tank bottom.

18. The process according to claim 1, wherein the volume of the gas phase in the storage tank is at least 5% by volume of the liquid or mixture volume stored in the storage tank.

19. The process according to claim 1, wherein the liquid or mixture fed into the storage tank as a motive jet comprises a portion or the entirety of a portion of the liquid or mixture stored in the storage tank which has been withdrawn beforehand from the storage tank.

20. The process according to claim 1, wherein the liquid or mixture fed into the storage tank as a motive jet does not comprise a portion of the liquid or mixture stored in the storage tank which has been withdrawn beforehand from the storage tank.

21. The process according to claim 1, wherein the liquid or mixture fed into the storage tank as a motive jet has been conducted through a heat exchanger beforehand.

22. A process for mixing a second liquid into a first liquid in a storage tank, and storage tank comprising a gas suction apparatus and a motive jet of the second liquid supplied into the storage tank, wherein said gas suction apparatus is disposed entirely in the first liquid, with the proviso that the first liquid in the storage tank fills only part of the internal volume of the storage tank occupiable by a fluid phase and the remaining occupiable internal volume of the storage tank is filled by a gas phase, wherein the gas suction apparatus, with the aid of the motive jet, sucks in gas from the gas phase stored in the storage tank and releases the sucked-in gas together with the motive jet into the first liquid stored in the storage tank, wherein said gas phase is recycled from said gas suction apparatus through said first liquid and returned to said gas phase, and the first liquid stored in the storage tank comprises a compound having at least one ethylenically unsaturated moiety, and the second liquid supplied as a motive jet is a solution of free-radical polymerization inhibitor.

23. The process according the claim 22, wherein the first liquid stored in the storage tank comprises a compound having at least one ethylenically unsaturated moiety, and the second liquid supplied as a motive jet is an inhibitor solution which comprises at least 10% by weight of phenothiazine, from 5 to 10% by weight of p-methyoxyphenol and at least 50% by weight of N-methylpyrrolidone.

* * * * *